US009868612B2

(12) United States Patent
Priem et al.

(10) Patent No.: US 9,868,612 B2
(45) Date of Patent: Jan. 16, 2018

(54) ARRANGEMENT OF ELONGATED ELEMENT ON EMPTY SPOOL

(71) Applicant: NV BEKAERT SA, Zwevegem (BE)

(72) Inventors: Johan Priem, Roeselare (BE); Johan Hugelier, Harelbeke (BE)

(73) Assignee: NV BEKAERT SA, Zwevegem (BE)

( * ) Notice: Subject to any disclaimer, the term of this patent is extended or adjusted under 35 U.S.C. 154(b) by 95 days.

(21) Appl. No.: 14/774,828

(22) PCT Filed: Mar. 11, 2014

(86) PCT No.: PCT/EP2014/054619

§ 371 (c)(1),
(2) Date: Sep. 11, 2015

(87) PCT Pub. No.: WO2014/180587

PCT Pub. Date: Nov. 13, 2014

(65) Prior Publication Data

US 2016/0031672 A1 Feb. 4, 2016

(30) Foreign Application Priority Data

May 7, 2013 (EP) ..... 13166743

(51) Int. Cl.
*B65H 65/00* (2006.01)
*B65H 54/34* (2006.01)
(Continued)

(52) U.S. Cl.
CPC ..... *B65H 65/00* (2013.01); *B21C 47/04* (2013.01); *B21F 1/00* (2013.01); *B65H 54/343* (2013.01); *B65H 2701/36* (2013.01)

(58) Field of Classification Search
CPC ..... B65H 65/00; B65H 75/28; B65H 75/285; B65H 54/343; B65H 2701/36; B21C 47/04; B21F 1/00
(Continued)

(56) References Cited

U.S. PATENT DOCUMENTS 4,610,404 A * 9/1986 Maccaferri ..... B65H 65/00 242/473.7

FOREIGN PATENT DOCUMENTS

DE 29 14 898 A1 10/1980
EP 0580228 A1 1/1994
(Continued)

OTHER PUBLICATIONS

Machine Translation of JP S57-195075, dated Nov. 30, 1982.*
International Search Report dated Apr. 2, 2014, for PCT/EP2014/054619.

*Primary Examiner* — William E Dondero
(74) *Attorney, Agent, or Firm* — Bacon & Thomas, PLLC

(57) ABSTRACT

An arrangement of an elongated element wound on a spool is presented. The elongated element has a leading end having a bent part and an unbent part. The bent part further having a beginning part and a trailing end. The leading end is positioned on the core of the spool and the bent part deviates at least for a part from a winding direction. The elongated element further forms subsequent windings in the winding direction on the core. At least one of the subsequent windings is wound over the beginning part of the bent part while an adhesive is provided to fix the trailing end of the bent part on the core simultaneously thereby securing elongated element on the spool.

17 Claims, 3 Drawing Sheets

(51) Int. Cl.
*B21F 1/00* (2006.01)
*B21C 47/04* (2006.01)

(58) Field of Classification Search
USPC ..... 242/476.2–476.5
See application file for complete search history.

(56) References Cited

FOREIGN PATENT DOCUMENTS

| | | | |
|---|---|---|---|
| JP | S50 118168 | A | 9/1975 |
| JP | S57 195075 | A | 11/1982 |
| JP | S62 282726 | A | 12/1987 |
| JP | H04 16467 | A | 1/1992 |
| JP | H11 245036 | A | 9/1999 |
| WO | 2012/032645 | A1 | 3/2012 |
| WO | 2014/005734 | A1 | 1/2014 |

* cited by examiner

ARRANGEMENT OF ELONGATED ELEMENT ON EMPTY SPOOL

FIELD OF THE INVENTION

The invention relates to an arrangement of an elongated element wound on a spool. The invention also relates to a method of securing an elongated element wound on a spool. The invention particularly relates to the securement of an elongated element on an empty spool.

BACKGROUND

The prior art provides a variety of ways and methods to secure an elongated element on an empty spool.

An adhesive tape may be provided on the core of the spool to hold the leading end of the elongated element on the spool.

An alternative is to provide the leading end with a glue, e.g. hot melt.

Still another way is to have spools where either the core or one or both flanges is or are provided with a spring-like clip to hold the leading end of the elongated element.

EP-A1-0 580 228 discloses a spool with a core and where this core has at least one fixing hole. The leading end of the elongated element is plastically bent. A reference mark is provided on the spool to indicate the location of the fixing hole and to facilitate its finding and putting the bent part in the hole.

JP-A-04-016467 discloses a wire winding device to automatically fix a leading end on an empty spool in a winding process. The leading end comprises a bent part. During the start of the winding process, the first windings are wound over the bent part to securely fix the wire on the spool.

All of the above-mentioned ways to secure a leading end of an elongated element to a spool have their disadvantages.

Use of an adhesive tape or of a glue, e.g. a hot melt, may slow down the transfer of an elongated element from one spool to another spool or the fixing of the elongated element on a new spool, e.g. because the hot melt may need some time to harden and the adhesive tape may also need some time to fix before carrying out the first and subsequent windings on a spool.

The use of a clip on the core of the spool or on the flange of the spool complicates the spool configuration and may lead to additional measures for guaranteeing a smooth last phase during unwinding.

Bending the leading end and fixing the bent part in a hole in the core of the spool necessitates sensor means for locating the hole and also slows down the fixing of the elongated element to the new spool.

Regarding the disadvantages of the wire winding device disclosed in JP-A-04-016467, during the unwinding process, the unwinding wire can not be used to its full length since fixing force decreases when unwinding. The wire gradually loses grip on the spool, which may lead to uncontrolled movement of a great length of the wire.

SUMMARY OF THE INVENTION

The primary object of the invention is to avoid the disadvantages of the prior art.

More particularly, it is an object of the invention to provide an alternative way of securing an elongated element on a spool.

It is yet another object of the present invention to simplify the way of securing an elongated element to a spool.

It is also an object of the present invention to allow later use of the elongated element along its complete or full length.

According a first aspect of the invention there is provided an arrangement of an elongated element wound on a spool generally in a winding direction. The elongated element has a leading end and the spool has a core; the leading end is positioned on said core. The leading end further comprises a bent part and an unbent part, at least the bent part is deviating at least for a part from the winding direction; the bent part further comprises a beginning part and a trailing end. The elongated element further forms subsequent windings in the winding direction on the core, at least one of the subsequent windings is wound over the beginning part, and the arrangement further comprises an adhesive, the adhesive is fixing the trailing end on the core of the spool.

The term "winding" refers to a 360° revolution of the elongated element on the spool. At least one of these subsequent windings is wound over the beginning part of the bent part thereby at least partly securing the elongated element on the spool. The term "spool" refers to a spool, a bobbin or a reel.

The terms "generally in a winding direction" refer to a direction which is either parallel to the flange or deviates with a pitch of one to seven, e.g. one to five, elongated elements from a direction parallel to the flange.

This means that for each winding, i.e. each 360° revolution, the elongated element has moved over a distance equal to one to seven times, e.g. one to five times, the diameter or thickness of the elongated element.

The leading end has a bent part and an unbent part. The terms "bent part" refer to that part of the leading end starting from the bending until the final end of the elongated element. At least the bent part deviates from the winding direction.

From the above it will be clear that it is allowed—during unwinding—to use the elongated element until its full length due to the adhesive.

Preferably, the adhesive is in the form of an adhesive tape. One can imagine that the form of a tape is not only easier and quicker to fix, but also more convenient to get rid of than other adhesives, e.g. compared with a hot melt. In addition, from a point of commercial view, an adhesive tape always costs less than other adhesives. Moreover, adhesive tapes no need long time to dry or to harden.

More preferably, the distance between the adhesive tape and the at least one of the subsequent windings is at least ten times the diameter of the elongated element. This separate location allows separate simultaneous actions—at least ten subsequent windings can be wound over the beginning part while getting to the adhesive arrangement, which can successfully avoid slowing down the winding process as the winding together with the fixing can be carried out at the same time.

Of course, it would be better to have a second winding also wound over the beginning part. One subsequent winding may not be strong enough for fastening the beginning part on the core of the spool, then, a second winding even a third winding, a fourth winding can further help to fix this part firmly.

According to the invention, the adhesive tape can be wound with one winding or revolution on the spool; it can also be wound with two windings or revolutions. Two windings or revolutions are definitely better than only one as the trailing end of the bent part is fixed more quickly and more firmly on the spool. In addition, securing the elongated element on the spool by one or two windings or revolutions of the adhesive tape going over the bent part may be done at a high speed so that the need to slow down the winding speed of the elongated element is minimized or so that the need to use an accumulator is minimized as well.

Preferably the bent part comprises a plastically deformed part so that the bent part does not jump completely back after having been bent.

The bent part may form a particular angle with the direction of the subsequent windings, where this angle ranges from 10° to 170°, e.g. from 20° to 160°, e.g. from 30° to 120°.

The elongated element may be a metal wire, e.g. a steel wire, or a metal cable, rope, strand or cord, e.g. a steel cord, a steel strand, a steel rope. The elongated element may be a coated element. Examples are a lacquered low carbon steel wire and a metal (copper, nickel, brass, bronze, zinc) high carbon steel wire.

According to a second aspect of the invention, there is provided a method of securing an elongated element to a spool where the elongated element is wound generally in a winding direction. The method comprises the steps of:

a. providing an elongated element with a leading end;
b. forming a bent part and an unbent part in said leading end;
c. positioning said leading end onto said core said bent part deviating at least for a part from said winding direction;
d. forming a first winding wound on the beginning part of said bent part on said spool in said winding direction;
e. providing an adhesive over the trailing end of said bent part.

Step d is separate from step e. Step d focuses on carrying out the winding over the beginning part of the bent part while in step e, an adhesive is provided in order to have the trailing end of the same bent part fixed on the spool. The two steps have a combined effect on the securing the leading end on the spool.

Preferably the method comprises the step of forming a bent part and an unbent part in the leading end, whereby at least the bent part but possibly also the unbent part deviates from the winding direction. High carbon steel wires may jump back to a large extent, while low carbon steel wires only jump back to a limited extent.

As a matter of a first example, a high carbon steel wire has a minimum carbon content of 0.65%, a manganese content ranging from 0.40% to 0.70%, a silicon content ranging from 0.15% to 0.30%, a maximum sulphur content of 0.03%, a maximum phosphorus content of 0.30%, all percentages being percentages by weight, the remainder being iron and unavoidable traces and impurities.

As a matter of a second example, a low carbon steel wire has a carbon content ranging between 0.04 wt % and 0.20 wt %. The complete composition of the low carbon steel wire may be as follows: a carbon content of 0.06 wt %, a silicon content of 0.166 wt %, a chromium content of 0.042 wt %, a copper content of 0.173 wt %, a manganese content of 0.382 wt %, a molybdenum content of 0.013 wt %, a nitrogen content of 0.006 wt %, a nickel content of 0.077 wt %, a phosphorus content of 0.007 wt %, a sulphur content of 0.013 wt %, the remainder being iron and unavoidable traces and impurities.

Preferably the method comprises the step of the subsequent windings comprising a second winding wound over said beginning part immediately after the first winding.

In a preferable embodiment of the second aspect of the invention, the second winding is already wound over the beginning part of the bent part and thus secures quickly the beginning part of the elongated element on the spool.

According to a preferable embodiment of the method according to the invention, the step of providing an adhesive is done without interrupting the formation of the subsequent windings, even without slowing down the start of the winding process and the formation of the subsequent windings.

In another preferable embodiment of the invention, the adhesive tape can be wound with two windings or revolutions on the spool in order to fasten the trailing end of the bent part of the leading end while the subsequent windings which secure the beginning part of the same bent part is wound on the spool simultaneously.

More preferably, the method according to the invention comprises a step of plastically deforming part of the bent part.

DETAILED DESCRIPTION OF THE INVENTION

Figure 1:
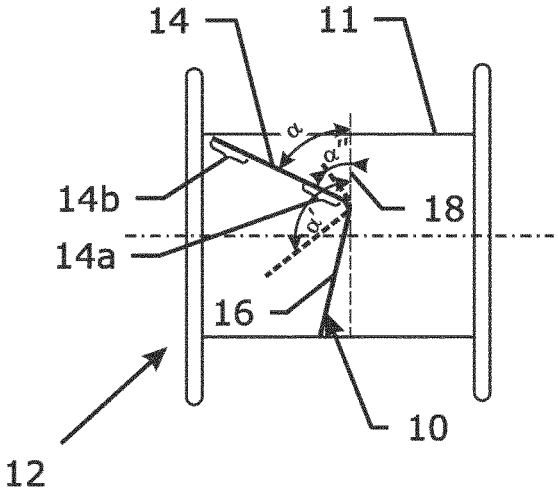
FIG. 1 shows an arrangement of a spool with a leading end of an elongated element.

FIG. 1 illustrates a leading end of a steel wire 10 on a core 11 of a spool 12. The leading end has a bent part 14 and an unbent part 16. The bent part 14 further comprises a beginning part 14*a* and a trailing end 14*b*. The direction of winding the steel wire 10 on the spool is indicated by line 18 with long dashes. Line 18 is more or less parallel to the flanges of the spool. Line 18 deviates from a line or plane parallel to the flanges by a pitch of one or more steel wires so that subsequent windings may lie adjacent to one another at the same level or height. The bent part 14 is that part which deviates from the line formed by the unbent part 16. The unbent part 16 may or may not deviate somewhat from the winding direction 18. The most important feature, however, is that the bent part 14 deviates from the winding direction 18 by an angle $\alpha$. This angle $\alpha$ may vary from a lower limit $\alpha''$ equal to about 10° to an upper limit $\alpha'$ equal to about 170°. The extreme positions possibly taken by the bent part 14 are shown by short dashes.

There may be various winding directions on one single arrangement. The heart of the invention, however, on one hand is that the bent part of the elongated element deviates from the winding direction of one or more of the subsequent windings, so that one or more of the subsequent windings go over the bent part and secure the elongated element to the spool; on the other hand, the bent part comprises a beginning part and a trailing end, the beginning part is separate from the trailing end, so that one or more of the subsequent windings are going over exactly on the beginning part of the bent part while an adhesive is provided to fix the trailing end of the same bent part separately. With both of the simultaneous securing arrangements, it is easy and effective to secure the elongated element to the spool.

Figure 2:
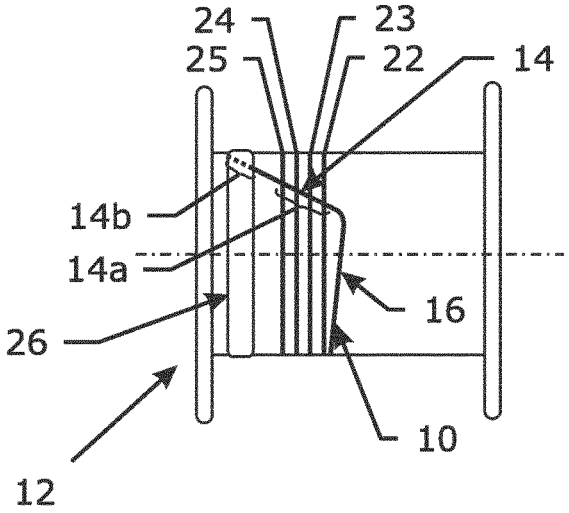
FIG. 2 shows an arrangement of a spool with an elongated element.

The reason for the bent part 14 making an angle α with the winding direction 18 is explained in FIG. 2. The steel wire 10 is wound on spool 12 and is making a second winding 22, a third winding 23, a fourth winding 24, a fifth winding 25 and so on . . . . Preferably the second winding 22 is already going over the beginning part 14*a* of the bent part 14 to secure quickly the steel wire 10 on the spool 12. At the same time, an adhesive 26 is provided to make sure the trailing end 14*b* of the bent part 14 fixed quickly on the spool.

The best range for the angle α is from 60° to 120°. The closer the angle α to 90°, the more likely one of the first subsequent windings goes over the beginning part 14*a* and secures the steel wire 10 to the spool 12.

The bent part 14 may be made manually in the leading end of the steel wire 10. However, a preferable way is to automate the bending and the securing of the steel wire 10 to the spool.

Figure 3A:
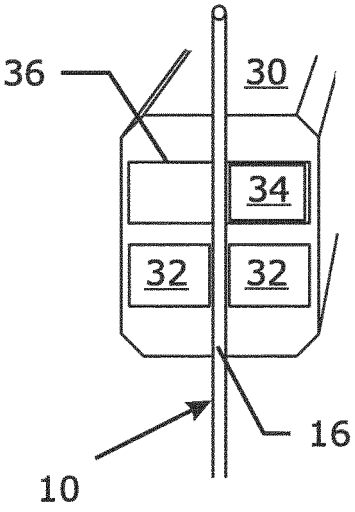
FIG. 3*a* and FIG. 3*b* illustrate the working of a device used to create a bent part in an elongated element.
Figure 3B:
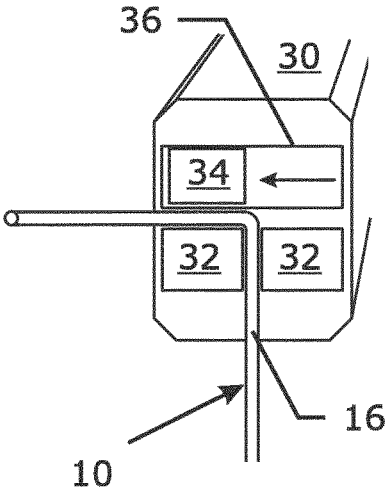

A possible and preferable tool to allow automation of the bending is illustrated in FIG. 3*a* and FIG. 3*b*.

FIG. 3*a* illustrates the head 30 of gripper. Steel wire 10 is caught between two hard metal cheeks 32. A hard metal bending part 34 is positioned above the right cheek 32 and, when prompted thereto, is able to move to the left direction in a groove 36. The groove 36 is situated above the two cheeks 32 leaving a gap between the path of the metal bending part 34 and the cheeks 32 that is not much greater than the diameter of the steel wire 10.

FIG. 3*b* illustrates the situation after bending. The metal bending part 34 has moved to the left and has bent the steel wire 10 over the left cheek 10. After releasing the steel wire 10, the bent part 14 may jump back to a certain degree depending upon the elasticity of the steel wire 10.

The invention is in principle independent of the form of the cross-section of the elongated element and of the diameter of the elongated element. For steel wires, practical embodiments are round cross-sections and diameters ranging from 0.10 mm to 4.0 mm, e.g. from 0.50 mm to 3.0 mm.

Figure 4:
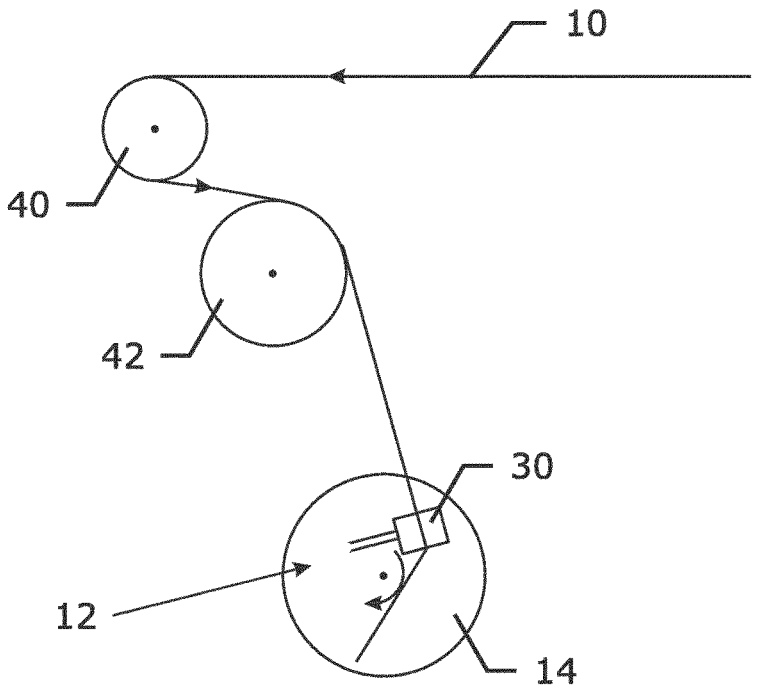
FIG. 4 illustrates the transfer of an elongated to a spool.

FIG. 4 illustrates schematically the situation just before securing the leading end of a steel wire 10 with a bent part 14 to a spool 12. This can be the case after another adjacent spool has been filled and after the steel wire has been cut. This transfer of a steel wire from one spool to another is disclosed in more detail in co-pending application PCT/EP2013/058013 filed on 17 Apr. 2013 and invoking the priority of EP121744962.6 filed on 4 Jul. 2012.

Steel wire 10 is coming from an upstream installation, e.g. a wire lacquering installation or a metal plating installation. The steel wire 10 is guided over a pulley 40 and driven by a capstan 42 towards the spool 12. A gripper head 30 holds the leading end of the steel wire 10. The bent part 14 is the part of the steel wire 10 sticking out of the gripper head 30.

Figure 5:
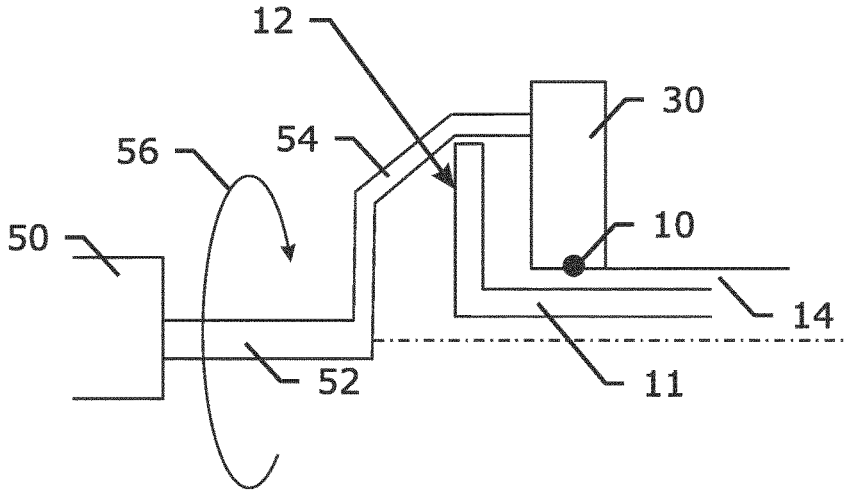
FIG. 5 shows a device to carry out the first and subsequent windings on a spool.

FIG. 5 illustrates a way and a device to carry out the first and subsequent windings on a spool 12 and to secure the steel wire 10 to the spool 12. The gripper head 30 is connected to a support 50 via an axle 52 and an arm 54. The axle 52 is positioned in line with the rotation axis of the spool 12. The arm 54 is intended to bring the steel leading end of the steel wire 10 over the flange of the spool 12. Axle 52 is rotatable in the direction of arrow 56 in order to form a first and subsequent windings of the steel wire 10 on the core 18 of the spool 12. After the first subsequent windings have secured the steel wire 10 to the spool 12, the gripper releases the steel wire and moves away from the spool to allow the further winding of the steel wire 10.

Figure 6:
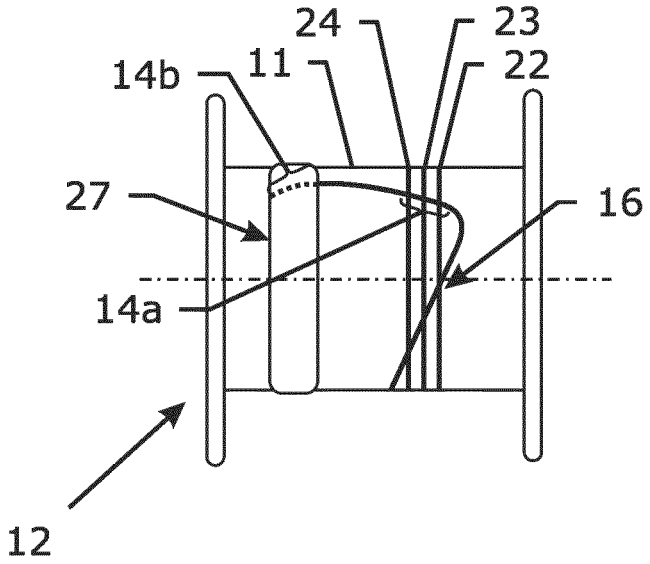
FIG. 6 shows a first alternative arrangement of a spool with an elongated element.

FIG. 6 illustrates an alternative arrangement of the fixing of the leading end of a steel wire to a spool 12. In this alternative embodiment the leading end has an unbent part 16 and a bent part 14 with a beginning part 14*a* and a trailing end 14*b*. The direction of the bent part 14 deviates from the winding direction and the second winding 22, third winding 23 go over the beginning part 14*a* and fix the steel wire to the core 11 of the spool 12. Simultaneously an adhesive tape 27 is wound automatically with one winding on the trailing end 14*b* to the core 11 of the spool 12 without interrupting the formation of the subsequent windings.

Figure 7:
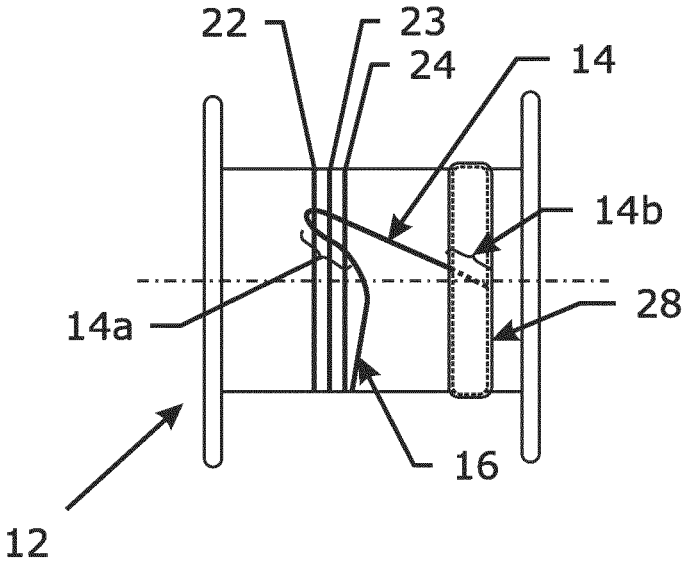
FIG. 7 shows a second alternative arrangement of a spool with an elongated element.

FIG. 7 shows another alternative arrangement of the fixing of the leading end to the core 11 of spool 12. The leading end has an unbent part 16 and a bent part 14 with a beginning part 14*a* and a trailing end 14*b*, the beginning part 14*a* deviating to a large degree from the winding direction and the trailing end 14*b* also deviating to a large degree from the winding direction. The second winding 22, third winding 23, fourth winding 24 go over the beginning part 14*a* and fix the steel wire to the core 11 of the spool 12 while an adhesive tape 28 is wound automatically with two or three windings on the trailing end 14*b* to the core 11 of the spool 12 without interrupting the formation of the subsequent windings afterwards.

LIST OF REFERENCE NUMBERS

10 steel wire
11 core of spool
12 spool
14 bent part
14*a* beginning part of bent part
14*b* trailing end of bent part
16 unbent part
18 winding direction
22 second winding
23 third winding
24 fourth winding
25 fifth winding
26 an adhesive
27 an adhesive tape with one winding
28 an adhesive tape with two windings
30 gripper head
32 cheeks
34 hard metal bending part
36 groove
40 guiding pulley
42 capstan
50 support for gripper
52 axle
54 arm
56 rotation direction of arm

The invention claimed is:

1. An arrangement of an elongated element wound on a spool generally in a winding direction, said elongated element having a leading end, said spool having a core, said leading end being positioned on said core, said leading end further comprising a bent part and an unbent part, at least said bent part deviating at least for a part from said winding direction, said bent part further comprising a beginning part and a trailing end, said beginning part being distinct from said trailing end, said elongated element further forming subsequent windings in said winding direction on said core, at least one of said subsequent windings being wound only over said beginning part, wherein said arrangement further comprises an adhesive, said adhesive fixing only said trailing end on said spool.

2. The arrangement according to claim 1, wherein a distance between said adhesive and said at least one of said subsequent windings is at least ten times the diameter of said elongated element.

3. The arrangement according to claim 2, wherein said subsequent windings comprise a second winding, said second winding being also wound only over said beginning part.

4. The arrangement according to claim 1, wherein said adhesive is a tape that is wound with one winding or revolution.

5. The arrangement according to claim 1, wherein said adhesive is a tape that is wound with two windings or revolutions.

6. The arrangement according to claim 1, wherein said bent part comprises a plastically deformed part.

7. The arrangement according to claim 1, wherein said bent part forms an angle with the winding direction windings, said angle ranging from 10° to 170°.

8. The arrangement according to claim 7, wherein said bent part forms an angle with the winding direction windings, said angle ranging from 30° to 120°.

9. The arrangement according to claim 1, wherein said elongated element is a metal elongated element.

10. The arrangement according to claim 9, wherein said metal elongated element is selected from the group consisting of a steel wire, a steel cord, a steel strand, and a steel rope.

11. The arrangement according to claim 1, wherein the elongated element has a diameter between 0.1 mm and 4.0 mm.

12. The arrangement according to claim 1, wherein the beginning part deviates from the winding direction in one direction towards one end of the spool and is bent in an opposite direction towards the other end of the spool towards the trailing end.

13. The arrangement according to claim 1, wherein the at least one of said subsequent windings is wound only over said beginning part on one part of the core, and said adhesive fixing only said trailing end on said spool is on a different part of the core.

14. A method of securing an elongated element to a spool where said elongated element is wound generally in a winding direction, said spool having a core, said method comprising the steps of:

a. providing an elongated element with a leading end;

b. forming a bent part and an unbent part in said leading end;

c. positioning said leading end onto said core, said bent part deviating at least for a part from said winding direction;

d. forming a first winding wound only on a beginning part of said bent part on said spool in said winding direction; and e. providing an adhesive only over a trailing end of said bent part.

15. The method according to claim 14, wherein subsequent windings comprise a second winding and wherein said second winding is wound only over said beginning part.

16. The method according to claim 14, said method comprises a step of plastically deforming said bent part.

17. The method of according to claim 14, wherein said step of providing an adhesive is done without interrupting the formation of subsequent windings.

* * * * *